United States Patent [19]

Robbins, III et al.

[11] Patent Number: 4,715,572

[45] Date of Patent: Dec. 29, 1987

[54] TRASH BAG RETAINER AND AIR VENTING DEVICE

[75] Inventors: Edward S. Robbins, III, 459 N. Court St., Florence, Ala. 35630; Gary T. Schwertner, St. Joseph, Tenn.

[73] Assignee: Edward S. Robbins, III, Florence, Ala.

[21] Appl. No.: 31,659

[22] Filed: Mar. 30, 1987

[51] Int. Cl.[4] ..... B65B 67/04

[52] U.S. Cl. ..... 248/101; 220/1 T; 220/404; 24/462

[58] Field of Search ..... 248/95, 97, 101, 152, 248/213.2; 220/1 T, 403, 404, 407; 24/462

[56] References Cited

U.S. PATENT DOCUMENTS

| | | | |
|---|---|---|---|
| 545,662 | 9/1895 | Stewart . | |
| 1,157,008 | 10/1915 | Lang | 220/410 |
| 1,613,621 | 1/1927 | Oke . | |
| 1,637,656 | 8/1927 | Radcliffe . | |
| 1,736,192 | 11/1929 | Easton | 220/403 |
| 1,953,042 | 3/1934 | Cody | 248/101 |
| 2,045,094 | 9/1936 | Murch . | |
| 2,177,328 | 10/1939 | Pender . | |
| 2,533,524 | 12/1950 | Snider . | |
| 2,678,764 | 5/1954 | Carlson | 220/404 |
| 3,057,506 | 10/1962 | Wetlesen . | |
| 3,102,661 | 9/1963 | Lundquist . | |
| 3,118,560 | 1/1964 | Cornelius | 220/469 |
| 3,204,866 | 9/1965 | Brighton et al. . | |
| 3,261,545 | 7/1966 | Frazier . | |
| 3,342,368 | 9/1967 | Matry . | |
| 3,411,659 | 11/1968 | Seifert . | |
| 3,484,011 | 12/1969 | Greenhalgh | 206/459 |
| 3,561,077 | 2/1971 | Grant . | |
| 3,648,920 | 3/1972 | Stump . | |
| 3,757,990 | 9/1973 | Buth | 248/101 |
| 3,815,778 | 6/1974 | Martin | 220/404 |
| 3,834,570 | 9/1974 | Barr | 220/403 |
| 3,870,261 | 3/1975 | McSwain . | |
| 3,893,649 | 7/1975 | Cornell et al. . | |
| 4,054,225 | 10/1977 | Frech | 220/404 |
| 4,122,973 | 10/1978 | Ahern | 220/404 |
| 4,238,868 | 12/1980 | Sternberg . | |
| 4,281,813 | 8/1981 | Garrity | 220/404 |
| 4,294,379 | 10/1981 | Bard | 220/404 |
| 4,304,379 | 12/1981 | Christensen . | |
| 4,387,924 | 4/1983 | Christensen . | |
| 4,416,197 | 11/1983 | Kehl | 220/1 T |
| 4,440,321 | 4/1984 | Campbell | 220/1 T |
| 4,535,911 | 8/1985 | Goulter | 220/1 T |
| 4,580,688 | 4/1986 | Harris | 220/1 T |

FOREIGN PATENT DOCUMENTS

| | | | |
|---|---|---|---|
| 180070 | 7/1962 | Sweden | 248/101 |

*Primary Examiner*—J. Franklin Foss
*Assistant Examiner*—Robert A. Olson
*Attorney, Agent, or Firm*—Nixon & Vanderhye

[57] ABSTRACT

A bag retaining and air venting device that is attachable to a trash receptacle. This device has at least one channel that preferably has a generally U-shaped, V-shaped or similarly shaped interior cross-section. In addition, includes means for firmly retaining a plastic bag liner in place with a trash or other receptacle and means for venting air from between the bag liner and the sidewall of the receptacle.

42 Claims, 6 Drawing Figures

FIG. 1
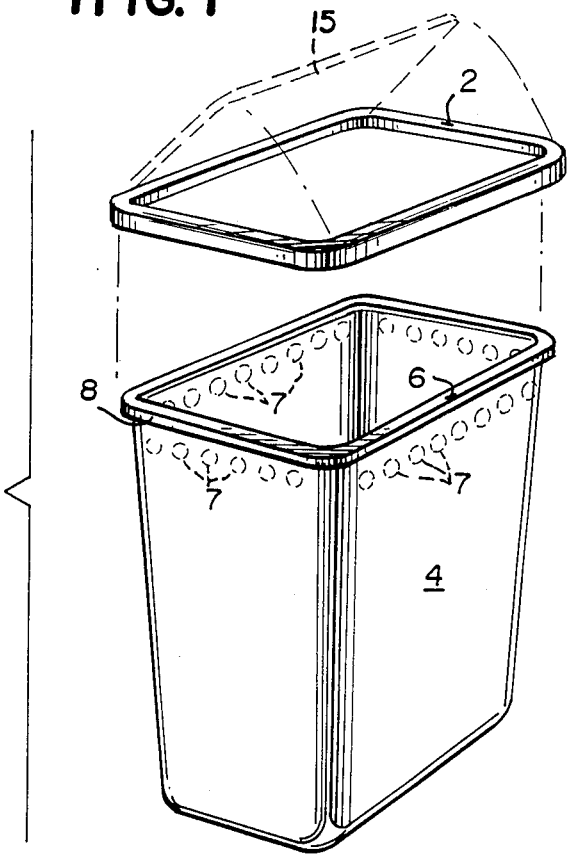
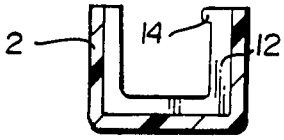
FIG. 6
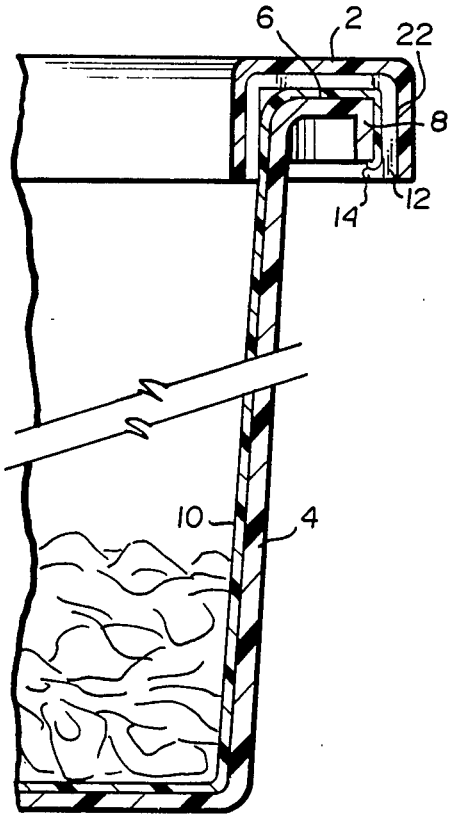
FIG. 2
FIG. 3
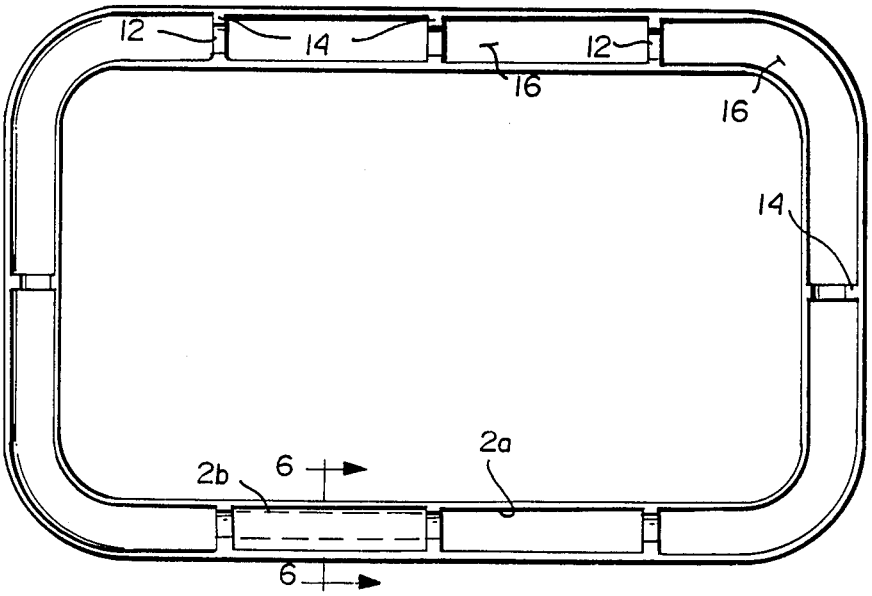

TRASH BAG RETAINER AND AIR VENTING DEVICE

FIELD OF THE INVENTION

This invention relates to the field of trash receptacles that utilize bag liners and is directed to several problems that have long existed in that field.

For example, one common problem occurs when the mouth of a bag liner is merely folded over the open end of a trash receptacle. As a result, when trash or other material is placed within the bag, the bag can be pulled either partially or completely within the trash receptacle so that it may fail to completely hold the trash. When this happens, the liner does not protect the inside of the receptacle and the receptacle may be rendered unsanitary, particularly in cases where liquid waste is involved, so that the receptacle normally must be manually cleaned.

Another common problem with the use of conventional bag liners relates to the entrapment of air between the bag liner and the inside walls of the receptacle. In this connection, air is often trapped in this manner when the liner is first placed within the trash receptacle and the mouth of the liner is folded over the top rim of the receptacle. This entrapped air prevents the bag liner from assuming its fullest possible configuration within the receptacle and, thereby, limits the amount of trash that can be held without manual adjustment.

Yet another common problem results from the use of bag liners that are larger than the receptacle in which they are placed. In this situation, a person has two choices when placing the liner within the receptacle. First, they can tie off the mouth of the liner which results in a snug fit of the liner to the rim of the receptacle. However, this action requires some considerable effort and frequently also results in the undesired entrapment of air as described above.

Alternatively, they can merely fold the mouth of the liner over the rim. In that case, however, the liner is loose and may fall or be pulled into the receptacle, whereby it may fail to serve its intended purposes as noted above.

DESCRIPTION OF THE PRIOR ART

Many types of trash receptacles have heretofore been proposed for use in receiving flexible, collapsible trash bag liners and the like.

One approach to these problems is disclosed in U.S. Pat. No. 3,815,778 which shows a rigid trash container that receives a plastic trash bag. The bag is held in place by a retainer collar and the entrapped air is vented solely through holes in the sidewalls of the container itself. While this approach is somewhat satisfactory, the use of holes in the sidewalls or bottom of the container is not desirable since (1) these holes are not attractive to customers and (2) the presence of such holes may permit the leakage of fluids outside of the receptacle when the liner is pierced or broken. (To the same effect, see U.S. Pat. Nos. 4,281,813 and 2,678,764.)

A modification of this approach is shown in U.S. Pat. Nos. 4,054,225 and 1,157,008. There, latches are employed on the container itself so that the container can be split open to remove the plastic bags or inner containers. This is a labor intensive action requiring stooping by the user. As a result, it is not generally accepted by consumers.

Another solution is achieved through the use of a self-venting double walled receptacle. See, e.g., U.S. Pat. No. 3,118,560. This approach, however, is quite expensive and is not believed to be readily adaptable with the use of plastic bag liners.

Alternatively, air conduits can be incorporated into the sidewalls of the refuse container in order to vent air as is shown in U.S. Pat. No. 1,736,192. However, that structure employes a complicated internal grid member 15 in combination with a rotating member 17 which serve to hold the upper ends of the bag in place inside of the container.

A less complicated structure is shown in U.S. Pat. No. 4,122,973. However, when the liner of the paint bucket is snapped into place, the air can no longer be vented. In addition, this reference is of only marginal relevance at best since it has a rigid, relatively thick liner.

U.S. Pat. No. 4,294,379 teaches yet another possible solution. It discloses a trash receptacle where trapped air is vented from between the trash liner and the receptacle by means of tubes along the sidewalls of the receptacle and notches placed in the upper rim of the receptacle. It fails to teach, however, any means to firmly hold the bag liner in place other than a lid 13. The problem with this lid is that its removal may pull, tear or otherwise impair the bag liner when it is in actual use. Thus, this solution is also not desirable.

A further potential approach is illustrated in U.S. Pat. No. 3,484,011 whereby an adapter or "stopper" type construction is used to hold a liner and to vent air. The liner and adapter may be an integral unit or they may be two separate units. In order to vent air, however, it is imperative that the liner not extend between the adapter and the container rim. As a result, the liner must be affixed solely to the bottom portion of the adapter. This approach is not believed to be practical in terms of trash receptacle devices.

Still another concept is disclosed in U.S. Pat. No. 1,953,042 which is directed to a bag emptying device, rather than a trash receptacle. There, a ring 25 is used as a locking device to secure a bag that is to be emptied. Handles 26 are provided so as to permit the ring to expand and contract during its placement over the rim of the container. (See lines 54–62.) However, there is no teaching of any means to vent entrapped air. The reason for this omission is directly related to the fact that it is a bag emptying device. Consequently, the bag is already full when the container is disposed around it and, thus, there is no concern about venting entrapped air.

Other waste receptacle related structures are shown in U.S. Pat. Nos. 4,378,924; 4,304,379; 4,238,868; 3,893,649; 3,870,261; 3,648,920; 3,561,077; 3,411,659; 3,342,368; 3,261,545; 3,204,866; 3,102,661; 3,057,506; 2,533,524; 2,177,328; 2,054,095; 1,637,656; 1,613,621; and 545,662. None of these references is believed to provide a complete solution to the problems identified above. Thus, for example, while some of these references teach various bag holding means, they fail to disclose any adequate air venting means.

BACKGROUND AND SUMMARY OF THE INVENTION

It is an object of the present invention to provide a simple device that not only firmly holds a bag liner in a trash receptacle but, also permits the escape or venting of air entrapped between the inside wall of the receptacle and the liner.

One embodiment of the present invention is a bag retaining and air venting device having at least one channel with a generally U-shaped, V-shaped or similarly shaped interior cross-section. Within this cross-section, there are a plurality of ribs (or other forms of locking mechanisms) that, in the preferred embodiment, have a lip (or other forms of latching means) on at least one edge portion of at least some of the ribs so as to more securely engage the device onto the flange or rim of the trash container. The spaces between the ribs in the interior cross-section of the device serve as a venting means for entrapped air.

Alternatively, additional venting means can be utilized in the device itself, or in the container. For example, portions of the interior cross-section can be enlarged so as to permit enhanced venting means. In addition, air conduits or equivalent structures can be formed in or attached to the walls of the container. Furthermore, notches or scalloped edges or holes can be placed along the rim or the upper sidewalls of the container.

It should further be appreciated that the bag retaining and venting device of this invention can be made of any suitable material. Presently, plastic and metal materials are believed to be superior. Likewise, the shape, dimensions and thicknesses of the device can be varied to suit the particular usage such as, for example, the size of the container and whether the device is to be reusable or not. Finally, although the preferred embodiment of the device is a one-piece unit, it is noted that it could be made in more than once piece.

It will also be apparent that other modifications and variations of this invention can be effected without departing from the scope or spirit of this invention as defined in the appended claims.

BRIEF DESCRIPTION OF THE DRAWINGS

FIG. 1 is an exploded view of an exemplary embodiment of the bag retaining and air venting device according to the present invention as applied to a "standard" trash container;

FIG. 2 is a partial cross-sectional view of the assembly trash receptacle shown in FIG. 1 depicting an exemplary embodiment of the bag retaining and air venting device and showing a flexible, collapsible trash liner therein;

FIG. 3 is a bottom view of the preferred embodiment of the bag retaining and air venting device in accordance with the invention showing the retaining and venting means;

FIG. 6 is a cross-section elevation view taken along line 6—6 of FIG. 3.

DESCRIPTION OF THE PREFERRED EMBODIMENT

Figure 4:
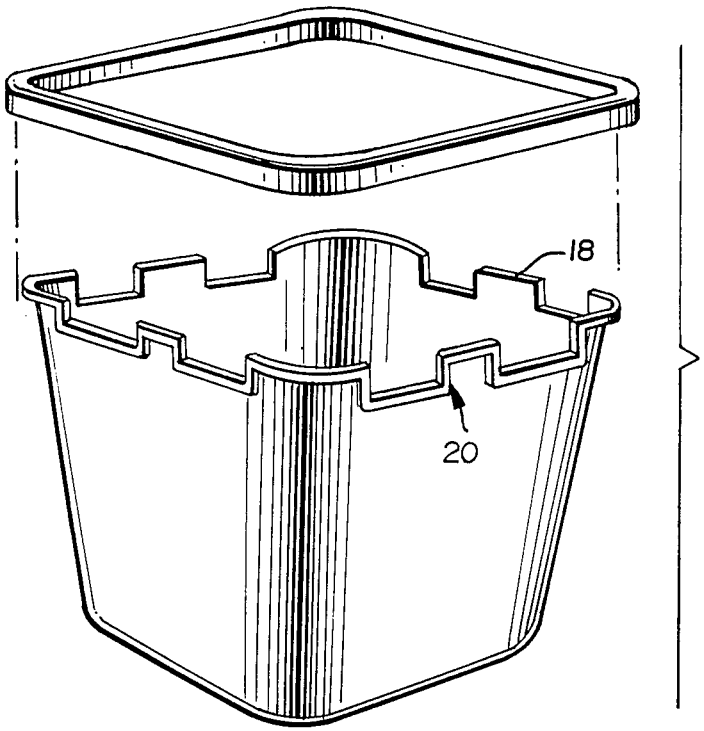
FIG. 4 is an exploded view of a trash container in accordance with the invention having scalloped or notched edges to allow additional venting of air.

The foregoing features and advantages of the present invention will become apparent with reference to the following detailed description taken in conjunction with the accompanying drawings.

FIG. 1 shows an exploded view of the preferred embodiment of a bag retaining and air venting device 2 along with a "standard" trash container 4 having a substantially rectangular open top end 6 defining flange 8. Device 2 comprises a one-piece generally rectangular channel 2*a* (FIG. 2) having a generally U-shaped interior cross-section configuration and is adapted to conform to the size and shape of the mouth or top end 6 of container 4. Preferably, container 4 is of the type having solid walls, but holes (shown in dotted line in FIG. 1 by reference numerals 7) could be formed in the upper sidewalls thereof.

As shown in FIG. 2, a flexible, collapsible trash liner 10 has been inserted into the container 4 and has been folded over end 6. Liner 10 is locked into place by device 2 which, as illustrated in FIG. 3, includes a plurality of U-shaped ribs 12 spaced apart and fixedly secured inside U-shaped channel 2*a*, i.e., in the interior cross-section of device 2. The plurality of U-shaped ribs 12 collectively define a separate interior channel area 2*b* within channel 2*a* (shown in dotted-line form in FIG. 3) which is sized to receive the top end 6 of trash container 4 and liner 10. Each of the ribs 12 also includes a projecting lip portion (latch) 14 that is preferably disposed on the outside bottom edge of rib 12. As device 2 is positioned over container 4 and end 6, latching means lip 14 cooperates with flange 8 in that it extends under flange 8 in order to firmly retain liner 10 between device 2 and end 6. It is by this means in the preferred embodiment that the liner 10 is securely held.

At the same time, spaces 16 between ribs 12 are open and, thereby, function to permit the escape of entrapped air as, for example, when trash is placed into the bag liner. Thus, liner 10 is not securely held in spaces 16 so as to allow the air to escape from between the walls of the receptacle and the liner to the outside atmosphere.

It is also noted that a lid or cover (shown in dashed line in FIG. 1 by reference numeral 15) may be used in connection with the present invention. This lid may be fixedly hinged (as shown in FIG. 1) or otherwise attached to device 2. Alternatively, it may comprise a completely separate unit that is adapted to be placed over or onto device 2.

Many variations in the present invention are contemplated and are to be included within the scope of this invention. For example, equivalent latching or retaining means to ribs 12 and lips 14 may be utilized within the interior cross-section of device 2 so long as device 2 functions to securely retain the bag liner and to vent entrapped air.

Furthermore, it can be appreciated that, while the channel of device 2 should preferably be generally U-shaped, V-shaped, or similarly shaped so as to fixedly engage the flange or rim of the container, the shape and configuration of the device may be of any desired design so long as device 2 functions to securely retain the bag liner and to vent entrapped air. Thus, for example, the invention may be modified so that the air venting spaces between ribs 12 are enlarged by changing the interior and/or exterior cross-sectional configuration of device 2.

In addition, FIG. 4 shows an exploded view of a modified container to which device 2 can be attached. In this embodiment, the mouth or top rim 18 of the receptacle is modified to have scalloped or notched portions 20 to further assist in the venting of entrapped air. That is, ribs 12 on bag retaining device 2, are disposed such that they are in direct alignment with the projecting top portions of container 4 (shown by way of example as item 18 on FIG. 4). Notched portions 20 can have virtually any desired depth. However, they preferably do not extend below the depth of exterior side 22 of device 2 (see FIG. 2). Consequently, the aesthetic appearance of container is such that it does not reveal the presence of scalloped or notched portions 20. In this regard, and as noted above, many consumers have objected in the past to a trash container receptacle having visible holes, notches or the like. Furthermore, the greater the depth of the scalloped or notched portions, the more likely leakage may occur if, for example, a liquid containing bag liner is pierced.

Figure 5:
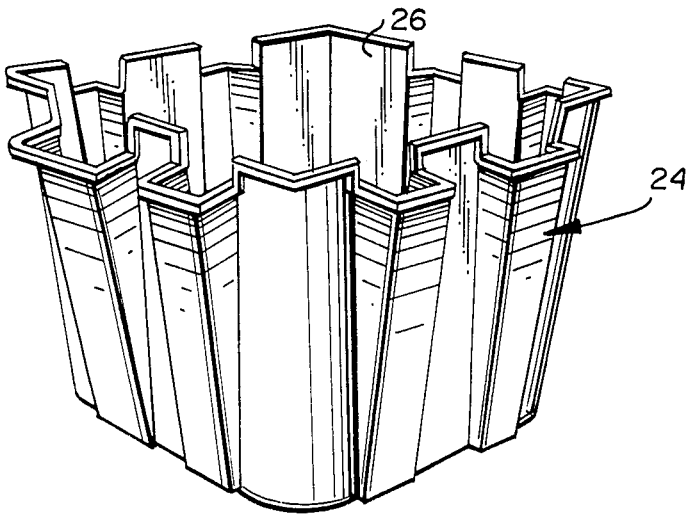
FIG. 5 is a view of an alternative embodiment of a trash container in accordance with the invention showing air conduit means incorporated in the sidewalls of the container.

FIG. 5 shows a view of a further modified embodiment of the present invention. Here, generally wedge-shaped pleats in container 4 define a plurality of air conduits 24 that are formed in the side of scalloped container 26. Alternatively, separate air conduit means (not shown) can be attached to the sides of the container.

As shown here, air conduits 24 do not end at the rim of container 26. However, by modifying the configuration of device 2 it can be readily appreciated that the conduits can be extended. Furthermore, it should be appreciated that the air conduits may take any desired shape or configuration.

Finally, it is contemplated that means can be affixed to the device to make it easier to remove the device from the container. Such means can take any form necessary or desired.

While the invention has been illustrated and described in detail herein, this description is to be considered as illustrative only and not restrictive in character. Thus, it is understood that merely the preferred embodiments have been shown and that all changes and modifications that come within the spirit of the invention are intended and desired to be protected.

In addition, while the invention has been described in connection with what is presently considered to be the most practical and preferred embodiments, it is to be understood that the invention is not to be limited to these embodiments, but, on the contrary, is intended to cover various modifications and equivalent arrangements included within the spirit and scope of the appended claims.

What is claimed is:

1. A device for securing a flexible liner within a trash receptacle for the type having a side wall and an open top, said device comprising:

a rim having an inner surface defining an interior cavity which is sized and configured to receive the top of said receptacle and an upper region of the flexible liner drapped thereover;

said rim including retaining means having at least one pair of ribs spaced apart from one another along said rim and projecting into said interior cavity thereof, each for removably securing said rim to the top of said receptacle and for holding a localized portion of said flexible liner against the top of said receptacle, such that another portion of said liner between said localized portions thereof is substantially unsecured against the top of said receptacle, wherein said retaining means establishes a space between said another portion of the liner and said inner surface of said rim, and wherein said retaining means allows said substantially unsecured another portion to flex into said established space thereby forming a vent between said unsecured another portion and the receptacle top to permit air trapped between the liner and the side wall of the receptacle to escape therethrough.

2. The device according to claim 1, wherein the interior cavity has a generally U-shaped configuration.

3. The device according to claim 1, wherein the retaining means includes a plurality of said rib pairs projecting into said interior cavity from said inner surface.

4. The device according to claim 3, wherein said ribs have a generally U-shaped configuration.

5. The device according to claim 3, wherein more than one of the retaining means has latching means for engagement with said open top of said receptacle.

6. The device according to claim 5, wherein said latching means includes a projecting lip on each of said ribs for engagement with the top of said receptacle.

7. The device according to claim 6, wherein said retaining means includes plural spaced-apart adjacent pairs of said ribs in combination with respective pairs of said projecting lips, said adjacent pairs of ribs for holding respective said localized portions of said flexible liner and for establishing therebetween respective said unsecured another portions, wherein respective said vents are formed between said respective unsecured another portions and said receptacle top.

8. The device according to claim 3, wherein said annular rim is comprised of plastic.

9. The device according to claim 3, wherein said annular rim is comprised of metal.

10. The device according to claim 3, wherein said annular rim is comprised of both plastic and metal.

11. The device according to claim 1, wherein said annular rim has a U-shaped configuration defining an interior channel sized to receive the top of said receptacle and said flexible liner.

12. The device according to claim 3, wherein said annular rim is reusable.

13. The device according to claim 3, wherein said annular rim is not reusable.

14. A trash receptacle having a body defining an annular opening at a top end thereof, and retaining means removably engagable with at least a portion of said top end for retaining a flexible liner inside said trash receptacle, wherein said retaining means includes:

an annular rim having an inner surface defining an interior cavity sized and configured to receive said top end of said receptacle and an upper portion of said flexible liner; and liner-retaining means formed with said rim and having at least one pair of ribs spaced-apart from one another along said rim, each said rib projecting a predetermined dimension into said interior cavity for engaging a localized region of said upper liner portion and for securing the same against said receptacle top end portion, while at least one other region of the upper liner portion remains unsecured between said localized secured regions respectively engaged by each of said ribs, said projected predetermined dimension of said ribs establishing at least one channel therebetween in registry with said unsecured one other region of said liner thereby providing vent means which allows said unsecured liner region to flex into said at least one channel in registry therewith and which, in turn, permits air trapped between said liner and said body to escape through an air passageway established between said flexed unsecured one other region of said liner and said top end portion of said receptacle.

15. The receptacle according to claim 14, wherein said channel has a generally U-shaped configuration.

16. The receptacle according to claim 14, wherein said liner-retaining means is formed with a plurality of said ribs, each projecting into said cavity and being spaced apart therealong relative to adjacent ones thereof.

17. The receptacle according to claim 16, wherein at least some of said ribs include latching means engagable with said top of said receptacle for removably coupling said rim thereto.

18. The receptacle according to claim 14, wherein the wall thickness of said annular rim of said securing means is approximately the same as the sidewalls of said receptacle.

19. The receptacle according to claim 14, wherein the wall thickness of said annular rim of said securing means is less than the sidewalls of said receptacle.

20. The receptacle according to claim 14, wherein said top end of said receptacle includes a plurality of scalloped or notched cutout portions.

21. The receptacle according to claim 14 further comprising auxiliary vent means cooperating with said first-mentioned vent means for assisting in the venting of air from said receptacle through air passages defined thereby.

22. The receptacle according to claim 21, wherein said auxiliary vent means include a plurality of air conduits formed as an integral part of said receptacle.

23. The receptacle according to claim 22, wherein said air conduits are wedge-shaped and are disposed immediately below said channel defined within said securing means.

24. The receptacle according to claim 16, wherein said ribs have a generally U-shaped configuration.

25. The receptacle according to claim 17, wherein said latching means consists of a projecting lip on each of said ribs of engagement with the top of said receptacle.

26. The receptacle according to claim 25, wherein said liner-retaining means includes a plurality of said ribs each having a projecting lip formed therewith, adjacent pairs of said ribs in combination with respective pairs of said projecting lips thereby defining a plurality of said channels, and thus said vent means, to establish plural said air passageways.

27. The receptacle according to claim 14, wherein said channel has a generally V-shaped configuration.

28. The receptacle according to claim 21, wherein said annular rim of said securing means is comprised of plastic.

29. The receptacle according to claim 21, wherein said annular rim of said securing means is comprised of metal.

30. The receptacle according to claim 21, wherein said annular rim of said securing means is comprised of both plastic and metal.

31. The receptacle according to claim 21, wherein said annular rim has a U-shaped configuration.

32. The receptacle according to claim 21, wherein said liner-retaining means further comprises a cover at least partially fixedly attached thereto.

33. A device adapted for retaining an upper portion of a flexible liner against a corresponding upper portion of a trash receptacle, said liner-retaining device including:

a rim having an inner surface which defines a cavity sized and configured to accept therein at least a part of said upper receptacle portion thereby removably coupling said rim thereto;

at least one pair of spaced-apart ribs each integrally formed with said rim on said inner surface thereof and projecting into said cavity defined thereby, wherein a localized region of said upper liner portion is captured between each said rib and said upper receptacle portion when said rim is removably coupled thereto which, in turn, retains said captured localized region of said upper liner portion thereagainst, and wherein, said inner surface of said rim also establishes, between said at least one pair of ribs, a channel such that an area of said liner between said captured localized regions is unsecured and is thus capable of flexing thereinto so as to form at least one vent between said flexed liner area and said upper receptacle portion, whereby air trapped between a lower portion of said liner and a lower portion of said receptacle is escapable therethrough.

34. A device as in claim 33 wherein said rim bounds said upper receptacle part.

35. A device as in claim 33 wherein several of said ribs are integrally formed with said rim.

36. A device as in claim 33 wherein said cavity is generally U-shaped in cross-section.

37. A device as in claim 33 wherein said upper receptacle portion is of the type having a flange and wherein said device further includes latch means which cooperates with said flange of said upper receptacle portion for removably coupling said rim thereto.

38. In combination, a trash receptacle having a wall which includes an upper portion defining an open top, and a device as in claim 33 removably coupled to said upper receptacle portion.

39. The combination comprising a trash receptacle adapted for receiving a flexible liner, said receptacle having a wall which establishes an open top at upper portion thereof to allow trash to be deposited thereinto, and retaining means for (1) retaining an upper portion of the liner against said upper receptacle portion, and (2) allowing air entrapped between the liner and an interior of said receptacle wall to be vented to the exterior thereof, said retaining means including:

a rim having an inner surface which defines a cavity sized and configured to accept therein at least a part of said upper receptacle portion thereby removably coupling said rim thereto;

at least one pair of spaced-apart ribs each integrally formed with said rim on said inner surface thereof and projecting into said cavity defined thereby, wherein respective localized regions of said upper liner portion are captured between each said rib and said upper receptacle portion which, in turn, retains said captured localized regions of said upper liner portion thereagainst, and wherein, said inner surface of said rim, between said at least one pair of ribs, also establishes a channel such that an area of said liner between said captured localized regions is unsecured and is capable of flexing thereinto so as to form at least one vent between said flexed liner area and said upper receptacle portion, whereby air trapped between a lower portion of said liner and a lower portion of said receptacle is escapable therethrough.

40. The combination as in claim 39 wherein said upper portion of said receptacle wall includes auxiliary vent means for assisting in the venting of said entrapped air.

41. The combination as in claim 40 wherein said auxiliary vent means is in the form of holes, notches or scalloped portions.

42. A trash receptacle as in claim 14 further having holes formed in said body near said annular opening thereof.

* * * * *